US008820951B2

(12) United States Patent
Yriberri et al.

(10) Patent No.: US 8,820,951 B2
(45) Date of Patent: Sep. 2, 2014

(54) LED-BASED LIGHT SOURCE WITH HYBRID SPOT AND GENERAL LIGHTING CHARACTERISTICS

(71) Applicant: Xicato, Inc., San Jose, CA (US)

(72) Inventors: John S. Yriberri, San Jose, CA (US); Gerard Harbers, Sunnyvale, CA (US)

(73) Assignee: Xicato, Inc., San Jose, CA (US)

( * ) Notice: Subject to any disclaimer, the term of this patent is extended or adjusted under 35 U.S.C. 154(b) by 7 days.

(21) Appl. No.: 13/758,856

(22) Filed: Feb. 4, 2013

(65) Prior Publication Data

US 2013/0148350 A1 Jun. 13, 2013

Related U.S. Application Data

(60) Provisional application No. 61/595,523, filed on Feb. 6, 2012.

(51) Int. Cl.
*F21V 9/16* (2006.01)

(52) U.S. Cl.
USPC .... 362/84; 362/256; 362/311.02; 362/311.06

(58) Field of Classification Search
USPC ..... 362/84, 255, 256, 311.01, 311.02, 362/311.06, 311.11, 311.14
See application file for complete search history.

(56) References Cited

U.S. PATENT DOCUMENTS

| | | | | |
|---|---|---|---|---|
| 1,588,222 | A | 6/1926 | Olier | |
| 2,263,622 | A * | 11/1941 | Gabriel | 362/363 |
| 5,959,316 | A | 9/1999 | Lowery | |
| 6,186,649 | B1 * | 2/2001 | Zou et al. | 362/296.02 |
| 6,351,069 | B1 | 2/2002 | Lowery et al. | |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,250,715 | B2 | 7/2007 | Mueller et al. | |

(Continued)

FOREIGN PATENT DOCUMENTS

DE 102009035370 A1 2/2011

OTHER PUBLICATIONS

Machine translation in English of Abstract for DE 102009035370 visited at www.espacenet.com on Jul. 23, 2013, 2 pages.

(Continued)

*Primary Examiner* — Y My Quach Lee
(74) *Attorney, Agent, or Firm* — Silicon Valley Patent Group LLP

(57) ABSTRACT

A luminaire includes an LED based illumination device with a light emitting area and an optical element that is configured to produce a hybrid emission pattern with a spot beam emitted within a predetermined far field angle and a background level spherical emission pattern. The optical element, for example, may be configured with an input port and an output port, and a perimeter that increases in size from the input port to a maximum perimeter and decreases from the maximum perimeter to the output port. The optical element receives an amount of light from the LED based illumination device at the input port, emits a first portion of the light from a curved, semitransparent sidewall, and emits a second portion of the light at the output port, wherein the emission area of the output port is less than a maximum perimeter of the optical element.

18 Claims, 9 Drawing Sheets

(56) References Cited

U.S. PATENT DOCUMENTS

| | | | | |
|---|---|---|---|---|
| 7,479,662 | B2 | 1/2009 | Soules et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 7,758,223 | B2 * | 7/2010 | Osawa et al. | 362/256 |
| 2007/0081336 | A1 | 4/2007 | Bierhuizen et al. | |
| 2007/0235639 | A1 | 10/2007 | Rains, Jr. | |
| 2007/0268694 | A1 | 11/2007 | Bailey et al. | |
| 2009/0168395 | A1 * | 7/2009 | Mrakovich et al. | 362/84 |
| 2010/0277316 | A1 | 11/2010 | Schlangen et al. | |
| 2011/0110079 | A1 | 5/2011 | Jong | |
| 2011/0182068 | A1 | 7/2011 | Harbers et al. | |
| 2012/0026740 | A1 | 2/2012 | Kim et al. | |
| 2012/0163001 | A1 | 6/2012 | Bertram et al. | |
| 2013/0003346 | A1 * | 1/2013 | Letoquin et al. | 362/84 |
| 2013/0016508 | A1 * | 1/2013 | Progl et al. | 362/363 |

OTHER PUBLICATIONS

International Search Report and Written Opinion mailed on Jul. 9, 2013 for PCT Application No. PCT/2013/024772 filed on Feb. 5, 2013, 13 pages.

* cited by examiner

LED-BASED LIGHT SOURCE WITH HYBRID SPOT AND GENERAL LIGHTING CHARACTERISTICS

CROSS REFERENCE TO RELATED APPLICATIONS

This application claims priority under 35 USC 119 to U.S. Provisional Application No. 61/595,523, filed Feb. 6, 2012, which is incorporated by reference herein in its entirety.

TECHNICAL FIELD

The described embodiments relate to illumination modules that include Light Emitting Diodes (LEDs).

BACKGROUND

The use of light emitting diodes in general lighting is still limited due to limitations in light output level or flux generated by the illumination devices. Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a small selection of produced LEDs that meet the color and/or flux requirements for the application. Moreover, illumination devices that use LEDs sometimes are limited in the resulting emission pattern.

SUMMARY

A luminaire includes an LED based illumination device with a light emitting area and an optical element that is configured to produce a hybrid emission pattern with a spot beam emitted within a predetermined far field angle and a background level spherical emission pattern. The optical element, for example, may be configured with an input port and an output port, and a perimeter that increases in size from the input port to a maximum perimeter and decreases from the maximum perimeter to the output port. The optical element receives an amount of light from the LED based illumination device at the input port, emits a first portion of the light from a curved, semitransparent sidewall, and emits a second portion of the light at the output port, wherein the emission area of the output port is less than a maximum perimeter of the optical element.

Thus, in one aspect, an apparatus includes an LED based illumination device having at least one LED operable to emit an amount of light of a first color into a color conversion cavity, the LED based illumination device having at least one color converting element disposed in the color conversion cavity, wherein a portion of the amount of light emitted from the at least one LED is color converted to a second color and emitted through an output port of the LED based illumination device; and an optical element coupled to the LED based illumination device, the optical element having an input port and an output port, wherein a perimeter of the optical element increases in size from a perimeter at the input port to a maximum perimeter and decreases from the maximum perimeter to a perimeter at the output port.

In another aspect, an apparatus includes an optical element coupleable to an LED based illumination device with a planar light emitting area, the optical element comprising, an input port operable to receive an amount of light emitted from the LED based illumination device at least one curved, semitransparent sidewall operable to transmit a first portion of the amount of light, and an output port operable to transmit a second portion of the amount of light, wherein an emission area of the output port is less than a maximum perimeter of the optical element.

Further details and embodiments and techniques are described in the detailed description below. This summary does not define the invention. The invention is defined by the claims.

DETAILED DESCRIPTION

Reference will now be made in detail to background examples and some embodiments of the invention, examples of which are illustrated in the accompanying drawings.

Figure 1:
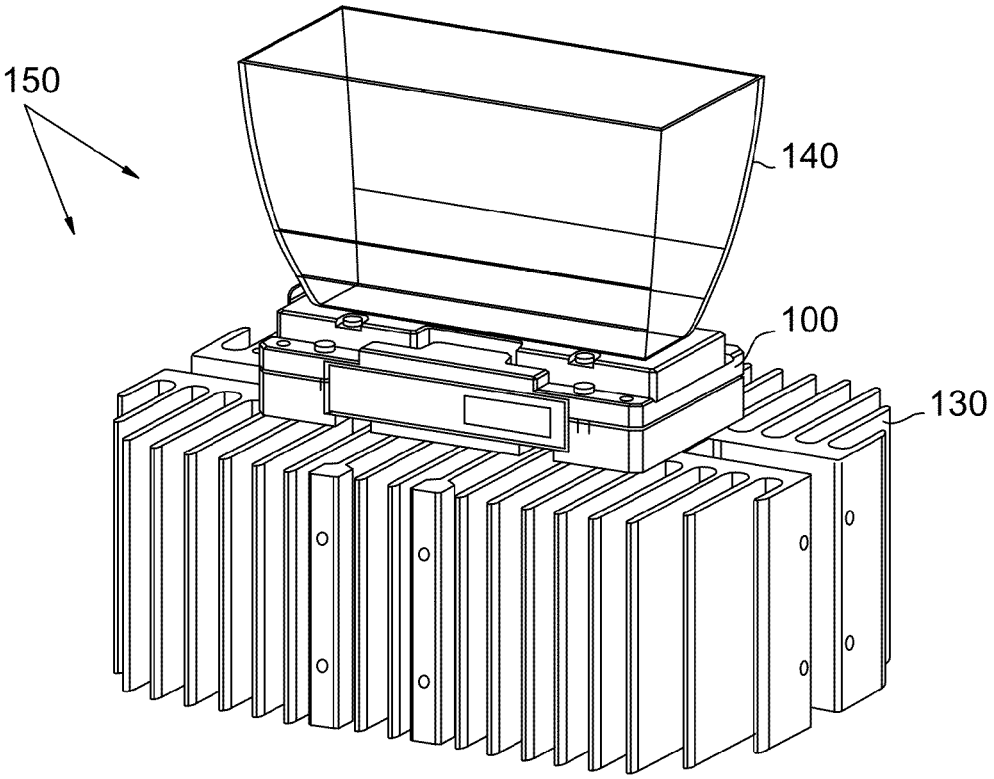
FIGS. 1, 2, and 3 illustrate three exemplary luminaires, including an illumination device, optical element, and light fixture.
Figure 2:
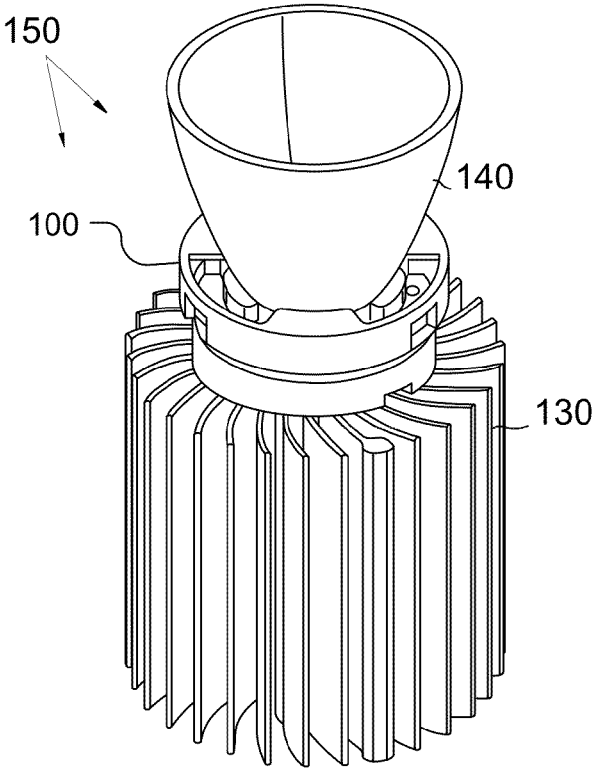
Figure 3:
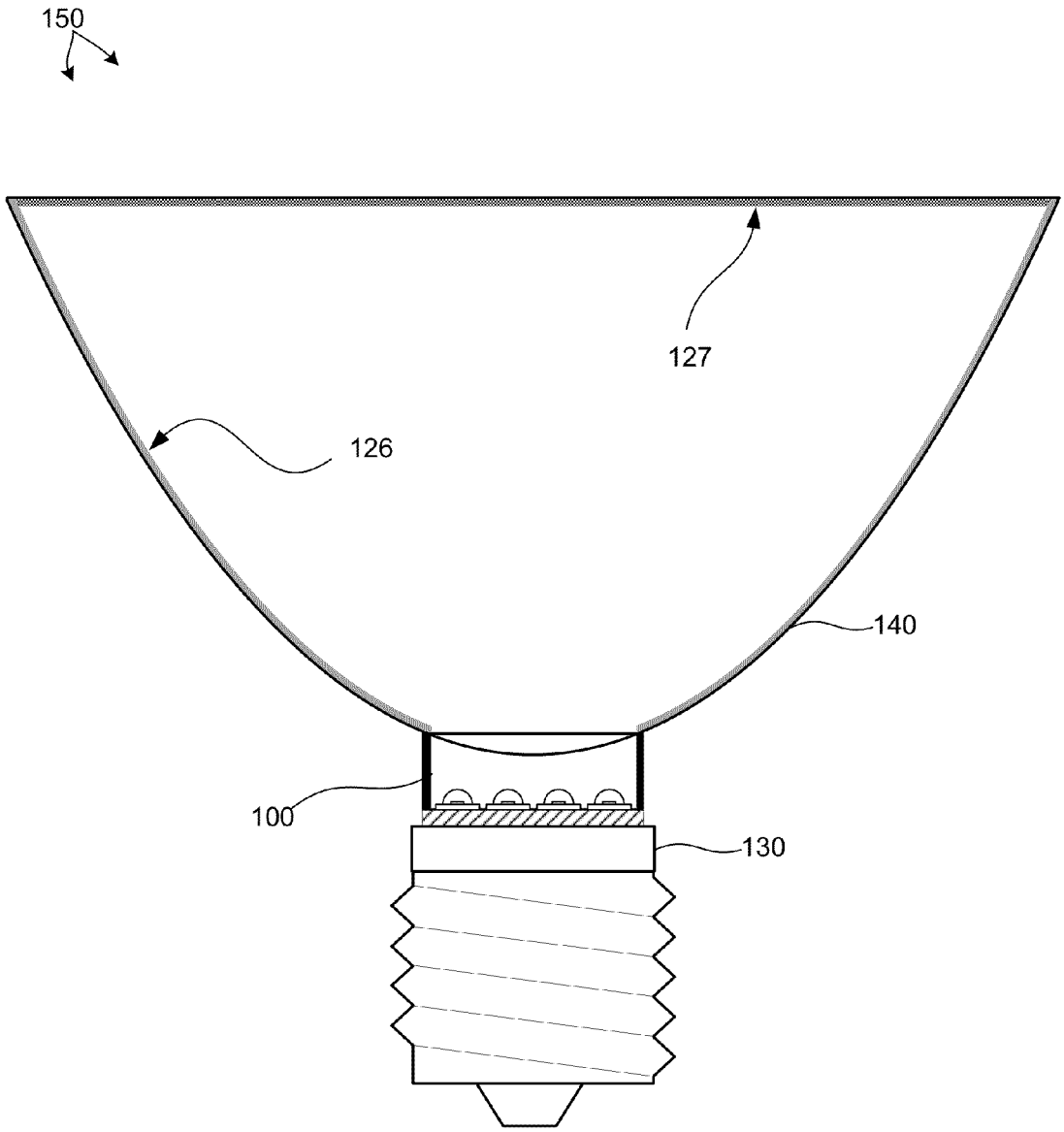

FIGS. 1, 2, and 3 illustrate three exemplary luminaires, all labeled 150. The luminaire illustrated in FIG. 1 includes an illumination module 100 with a rectangular form factor. The luminaire illustrated in FIG. 2 includes an illumination module 100 with a circular form factor. The luminaire illustrated in FIG. 3 includes an illumination module 100 integrated into a retrofit lamp device. These examples are for illustrative purposes. Examples of illumination modules of general polygonal and elliptical shapes may also be contemplated. Luminaire 150 includes illumination module 100, optical element 140, and light fixture 130. As depicted, light fixture 130 includes a heat sink capability, and therefore may be sometimes referred to as heat sink 130. However, light fixture 130 may include other structural and decorative elements (not shown). Optical element 140 is mounted to illumination module 100 to collimate or deflect light emitted from illumination module 100. The optical element 140 may be made from a thermally conductive material, such as a material that includes aluminum or copper and may be thermally coupled to illumination module 100. Heat flows by conduction through illumination module 100 and the thermally conductive optical element 140. Heat also flows via thermal convection over the optical element 140. Optical element 140 may be a compound parabolic concentrator, where the concentrator is constructed of or coated with a highly reflecting material. Optical element 140 or other optical elements, such as a diffuser, may be removably coupled to illumination module 100, e.g., by means of threads, a clamp, a twist-lock mechanism, or other appropriate arrangement. As illustrated in FIG. 3, the optical element 140 may include sidewalls 126 and a window 127 that are optionally coated, e.g., with a wavelength converting material, diffusing material or any other desired material.

As depicted in FIGS. 1, 2, and 3, illumination module 100 is mounted to heat sink 130. Heat sink 130 may be made from a thermally conductive material, such as a material that includes aluminum or copper and may be thermally coupled to illumination module 100. Heat flows by conduction through illumination module 100 and the thermally conductive heat sink 130. Heat also flows via thermal convection over heat sink 130. Illumination module 100 may be attached to heat sink 130 by way of screw threads to clamp the illumination module 100 to the heat sink 130. To facilitate easy removal and replacement of illumination module 100, illumination module 100 may be removably coupled to illumination module 100, e.g., by means of a clamp mechanism, a twist-lock mechanism, or other appropriate arrangement. Illumination module 100 includes at least one thermally conductive surface that is thermally coupled to heat sink 130, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heat sink contact area should be used. Using a larger heat sink 130 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination module 100.

Figure 4:
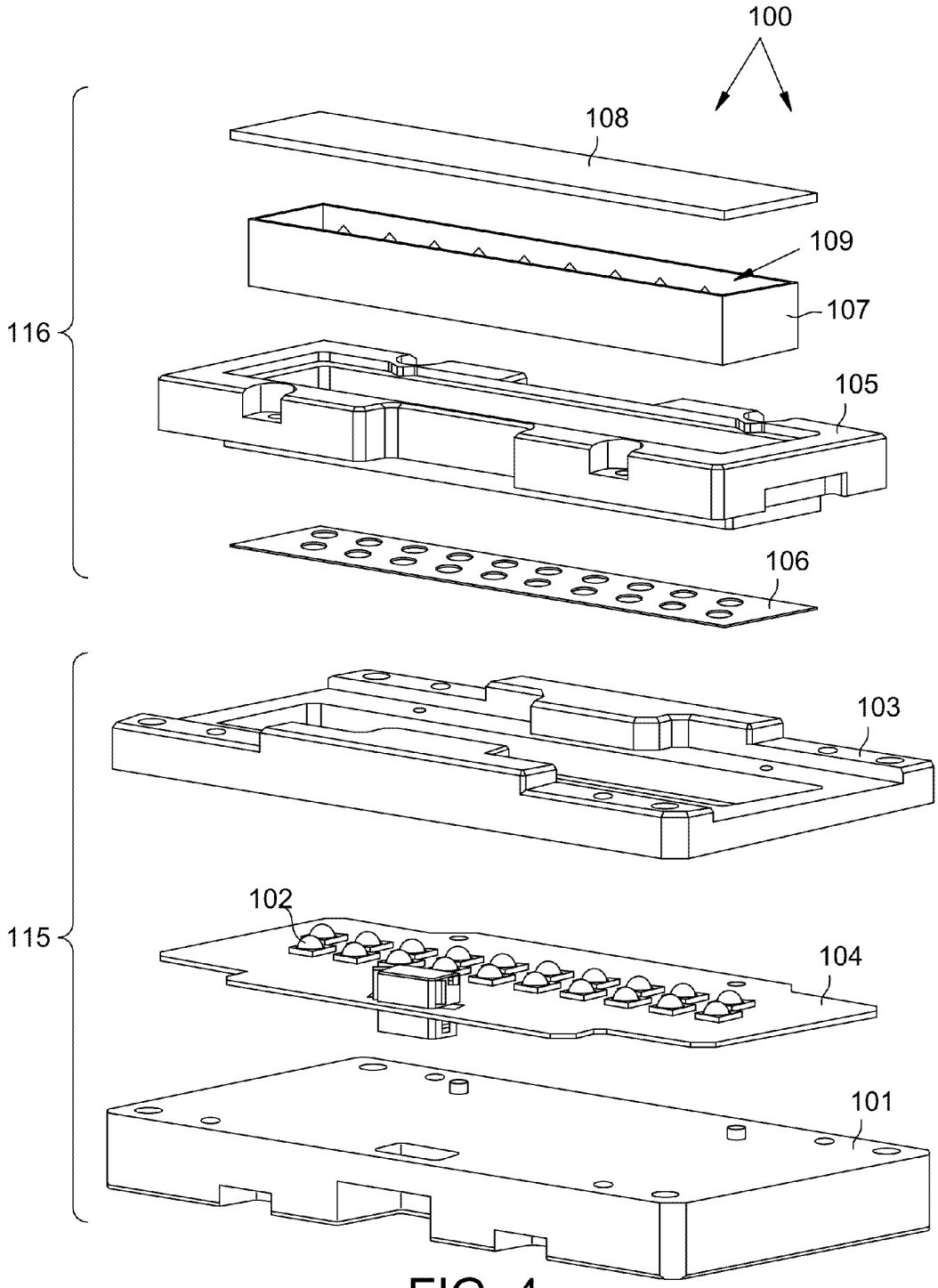
FIG. 4 illustrates an exploded view of components of the LED based illumination module depicted in FIG. 1.

FIG. 4 illustrates an exploded view of components of LED based illumination module 100 as depicted in FIG. 1 by way of example. It should be understood that as defined herein an LED based illumination module is not an LED, but is an LED light source or fixture or component part of an LED light source or fixture. For example, an LED based illumination module may be an LED based replacement lamp such as depicted in FIG. 3. LED based illumination module 100 includes one or more LED die or packaged LEDs and a mounting board to which LED die or packaged LEDs are attached. In one embodiment, the LEDs 102 are packaged LEDs, such as the Luxeon Rebel manufactured by Philips Lumileds Lighting. Other types of packaged LEDs may also be used, such as those manufactured by OSRAM (Oslon package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and an output port, which is illustrated as, but is not limited to, an output window 108. Light conversion sub-assembly 116 may include a bottom reflector 106 and sidewall 107, which may optionally be formed from inserts. Output window 108, if used as the output port, is fixed to the top of cavity body 105. In some embodiments, output window 108 may be fixed to cavity body 105 by an adhesive. To promote heat dissipation from the output window to cavity body 105, a thermally conductive adhesive is desirable. The adhesive should reliably withstand the temperature present at the interface of the output window 108 and cavity body 105. Furthermore, it is preferable that the adhesive either reflect or transmit as much incident light as possible, rather than absorbing light emitted from output window 108. In one example, the combination of heat tolerance, thermal conductivity, and optical properties of one of several adhesives manufactured by Dow Corning (USA) (e.g., Dow Corning model number SE4420, SE4422, SE4486, 1-4173, or SE9210), provides suitable performance. However, other thermally conductive adhesives may also be considered.

Either the interior sidewalls of cavity body 105 or sidewall insert 107, when optionally placed inside cavity body 105, is reflective so that light from LEDs 102, as well as any wavelength converted light, is reflected within the cavity 160 until it is transmitted through the output port, e.g., output window 108 when mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination module 100, other shapes may be contemplated (e.g., clover shaped or polygonal). In addition, the interior sidewalls of cavity body 105 may taper or curve outward from mounting board 104 to output window 108, rather than perpendicular to output window 108 as depicted.

Bottom reflector insert 106 and sidewall insert 107 may be highly reflective so that light reflecting downward in the cavity 160 is reflected back generally towards the output port, e.g., output window 108. Additionally, inserts 106 and 107 may have a high thermal conductivity, such that it acts as an additional heat spreader. By way of example, the inserts 106 and 107 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of inserts 106 and 107 with one or more reflective coatings. Inserts 106 and 107 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, inserts 106 and 107 may be made from a PTFE material. In some examples inserts 106 and 107 may be made from a PTFE material of one to two millimeters thick, as sold by W.L. Gore (USA) and Berghof (Germany). In yet other embodiments, inserts 106 and 107 may be constructed from a polytetrafluoroethylene PTFE material backed by a thin reflective layer such as a metallic layer or a non-metallic layer such as ESR, E60L, or MCPET. Also, highly diffuse reflective coatings can be applied to any of sidewall insert 107, bottom reflector insert 106, output window 108, cavity body 105, and mounting board 104. Such coatings may include titanium dioxide (TiO2), zinc oxide (ZnO), and barium sulfate (BaSO4) particles, or a combination of these materials.

Figure 5A:
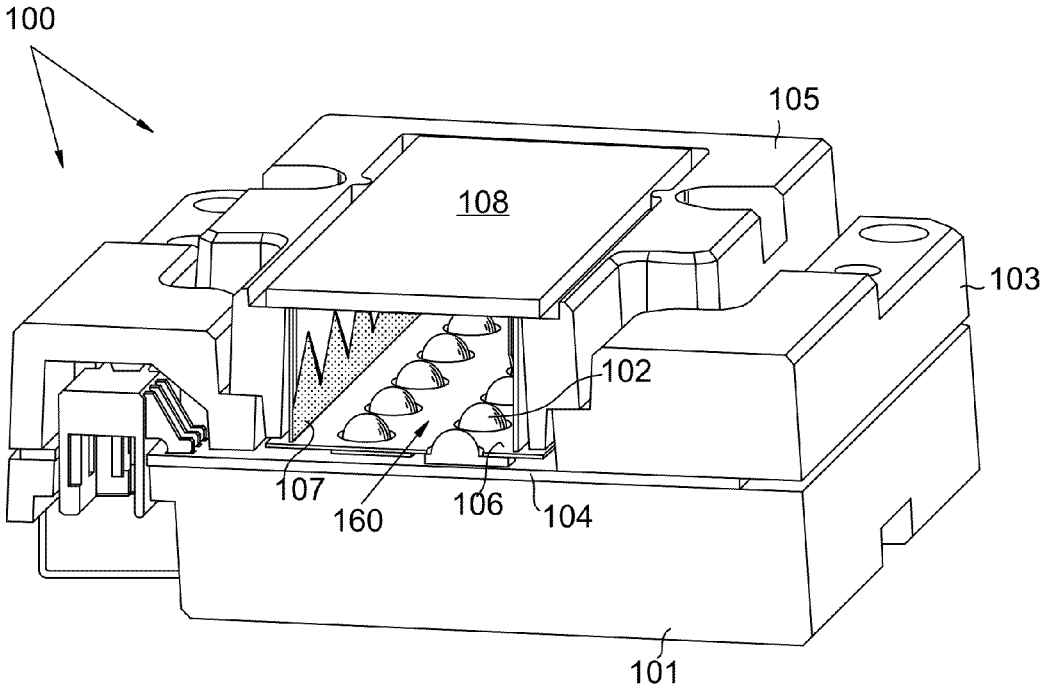
FIGS. 5A and 5B illustrate perspective, cross-sectional views of the LED based illumination module depicted in FIG. 1.
Figure 5B:
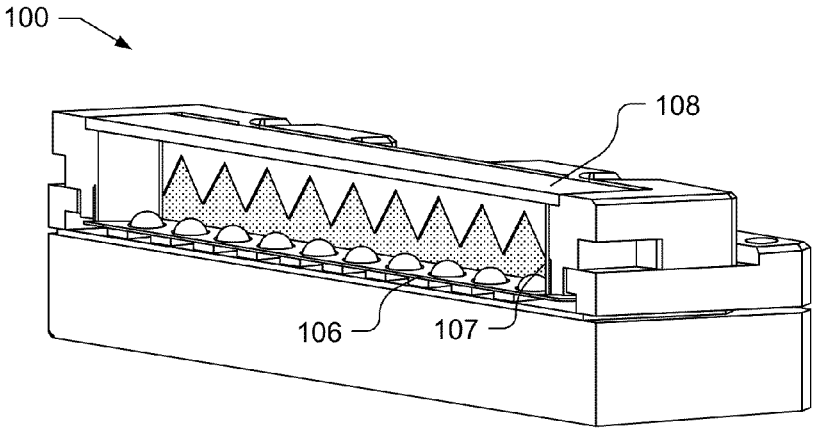

FIGS. 5A and 5B illustrate perspective, cross-sectional views of LED based illumination module 100 as depicted in FIG. 1. In this embodiment, the sidewall insert 107, output window 108, and bottom reflector insert 106 disposed on mounting board 104 define a color conversion cavity 160 (illustrated in FIG. 5A) in the LED based illumination module 100. A portion of light from the LEDs 102 is reflected within color conversion cavity 160 until it exits through output window 108. Reflecting the light within the cavity 160 prior to exiting the output window 108 has the effect of mixing the light and providing a more uniform distribution of the light that is emitted from the LED based illumination module 100. In addition, as light reflects within the cavity 160 prior to exiting the output window 108, an amount of light is color converted by interaction with a wavelength converting material included in the cavity 160.

LEDs 102 can emit different or the same colors, either by direct emission or by phosphor conversion, e.g., where phosphor layers are applied to the LEDs as part of the LED package. The illumination module 100 may use any combination of colored LEDs 102, such as red, green, blue, amber, or cyan, or the LEDs 102 may all produce the same color light. Some or all of the LEDs 102 may produce white light. In addition, the LEDs 102 may emit polarized light or non-polarized light and LED based illumination module 100 may use any combination of polarized or non-polarized LEDs. In some embodiments, LEDs 102 emit either blue or UV light because of the efficiency of LEDs emitting in these wavelength ranges. The light emitted from the illumination module 100 has a desired color when LEDs 102 are used in combination with wavelength converting materials included in color conversion cavity 160. The photo converting properties of the wavelength converting materials in combination with the mixing of light within cavity 160 results in a color converted light output. By tuning the chemical and/or physical (such as thickness and concentration) properties of the wavelength converting materials and the geometric properties of the coatings on the interior surfaces of cavity 160, specific color properties of light output by output window 108 may be specified, e.g., color point, color temperature, and color rendering index (CRI).

For purposes of this patent document, a wavelength converting material is any single chemical compound or mixture of different chemical compounds that performs a color conversion function, e.g., absorbs an amount of light of one peak wavelength, and in response, emits an amount of light at another peak wavelength.

Portions of cavity 160, such as the bottom reflector insert 106, sidewall insert 107, cavity body 105, output window 108, and other components placed inside the cavity (not shown) may be coated with or include a wavelength converting material. FIG. 5B illustrates portions of the sidewall insert 107 coated with a wavelength converting material. Furthermore, different components of cavity 160 may be coated with the same or a different wavelength converting material.

By way of example, phosphors may be chosen from the set denoted by the following chemical formulas: $Y_3Al_5O_{12}$:Ce, (also known as YAG:Ce, or simply YAG) $(Y,Gd)_3Al_5O_{12}$:Ce, CaS:Eu, SrS:Eu, $SrGa_2S_4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr,Ca)$AlSiN_3$:Eu, $CaAlSiN_3$:Eu, $CaAlSi(ON)_3$:Eu, $Ba_2SiO_4$:Eu, $Sr_2SiO_4$:Eu, $Ca_2SiO_4$:Eu, $CaSc_2O_4$:Ce, $CaSi_2O_2N_2$:Eu, $SrSi_2O_2N_2$:Eu, $BaSi_2O_2N_2$:Eu, $Ca_{5(}PO_4)_3Cl$:Eu, $Ba_{5(}PO_4)_3Cl$:Eu, $Cs_2CaP_2O_7$, $Cs_2SrP_2O_7$, $Lu_3Al_5O_{12}$:Ce, $Ca_8Mg(SiO_4)_4Cl_2$:Eu, $Sr_8Mg(SiO_4)_4Cl_2$:Eu, $La_3Si_6N_{11}$:Ce, $Y_3Ga_5O_{12}$:Ce, $Gd_3Ga_5O_{12}$:Ce, $Tb_3Al_5O_{12}$:Ce, $Tb_3Ga_5O_{12}$:Ce, and $Lu_3Ga_5O_{12}$:Ce.

In one example, the adjustment of color point of the illumination device may be accomplished by replacing sidewall insert 107 and/or the output window 108, which similarly may be coated or impregnated with one or more wavelength converting materials. In one embodiment a red emitting phosphor such as a europium activated alkaline earth silicon nitride (e.g., (Sr,Ca)$AlSiN_3$:Eu) covers a portion of sidewall insert 107 and bottom reflector insert 106 at the bottom of the cavity 160, and a YAG phosphor covers a portion of the output window 108. In another embodiment, a red emitting phosphor such as alkaline earth oxy silicon nitride covers a portion of sidewall insert 107 and bottom reflector insert 106 at the bottom of the cavity 160, and a blend of a red emitting alkaline earth oxy silicon nitride and a yellow emitting YAG phosphor covers a portion of the output window 108.

In some embodiments, the phosphors are mixed in a suitable solvent medium with a binder and, optionally, a surfactant and a plasticizer. The resulting mixture is deposited by any of spraying, screen printing, blade coating, or other suitable means. By choosing the shape and height of the sidewalls that define the cavity, and selecting which of the parts in the cavity will be covered with phosphor or not, and by optimization of the layer thickness and concentration of the phosphor layer on the surfaces of cavity 160, the color point of the light emitted from the module can be tuned as desired.

As depicted in FIGS. 1, 2, and 3, light generated by LEDs 102 is generally emitted from color conversion cavity 160, exits the output window 108, interacts with optical element 140, and exits luminaire 150. In one aspect, an optical element is introduced herein to generate a hybrid emission pattern from luminaire 150. The hybrid emission pattern includes a spot beam emitted within a predetermined far field angle and a background level spherical emission pattern. In this manner, light emitted from luminaire 150 appears intense within the predetermined far field angle of the spot beam with a sharp drop off in intensity beyond the predetermined far field angle to a general background lighting level. In one aspect, the optical element includes a shaped, semi-transparent sidewall surface that emits a portion of light emitted from LED based illumination module 100 in a spherical emission pattern. Furthermore, the optical element directs another portion of the light emitted from the LED based illumination module 100 toward an output port of the optical element that generates a spot beam of light. In this manner, luminaire 150 generates a hybrid light output that includes a defined spot beam and uniform, general illumination in all directions.

Figure 6:
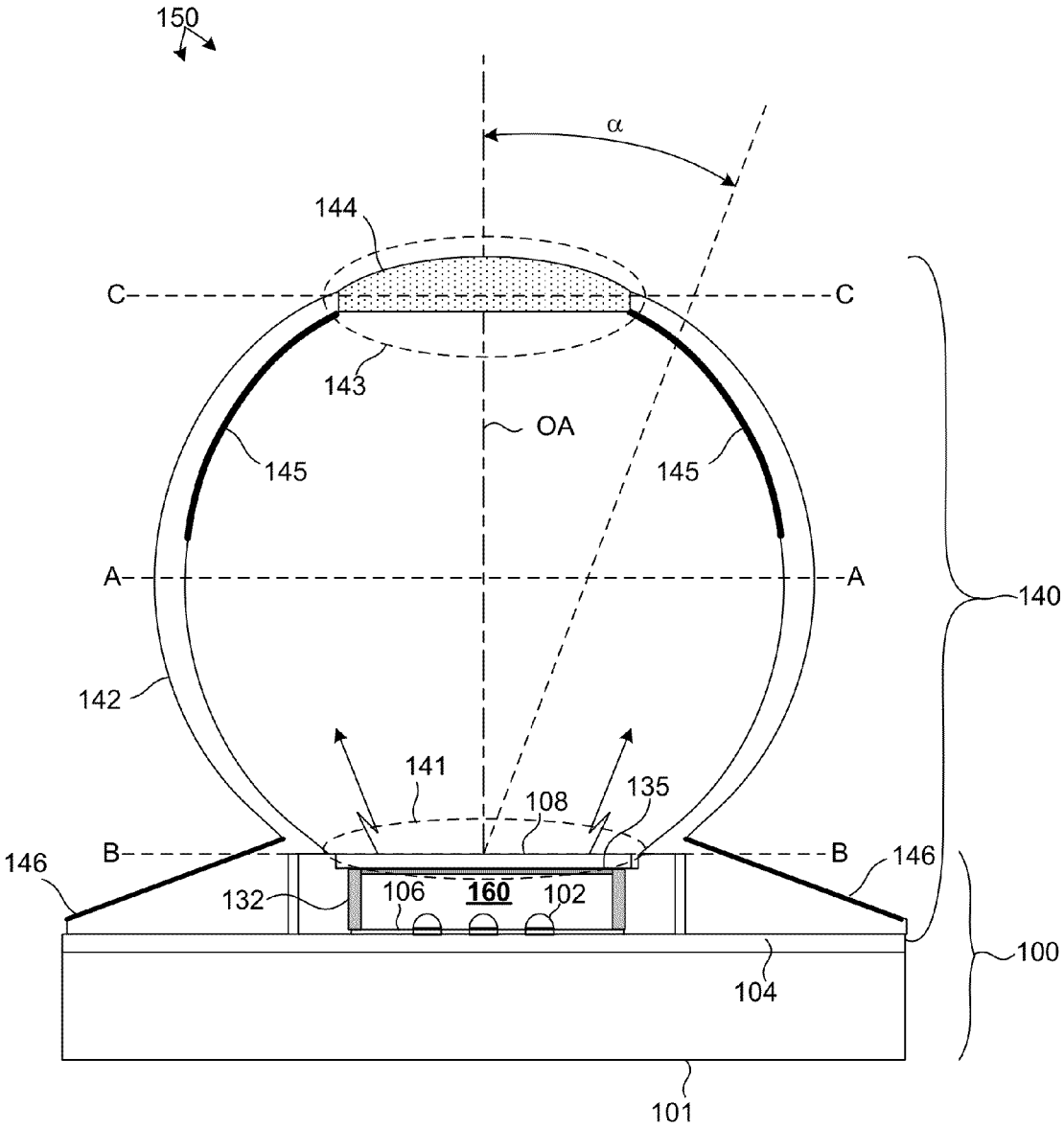
FIG. 6 is illustrative of a cross-sectional, side view of a luminaire that includes an optical element configured to produce a hybrid emission pattern with a spot beam emitted within a predetermined far field angle and a background level spherical emission pattern.

FIG. 6 is illustrative of a cross-sectional, side view of luminaire 150 in one embodiment. As illustrated, luminaire 150 includes LED based illumination module 100 and optical element 140. As depicted, LED based illumination module 100 has a circular shape (e.g., as illustrated in FIG. 2), however other shapes (e.g., as illustrated in FIG. 1) may be contemplated.

LED 102 of LED based illumination module 100 emits light directly into color conversion cavity 160. Light is mixed and color converted within color conversion cavity 160, e.g., by wavelength converting layers 132 and 135 and the resulting light is emitted by LED based illumination module 100. The light is emitted in a Lambertian (or near Lambertian) pattern over an extended surface (i.e., the surface of output window 108). As depicted in FIG. 6, the emitted light passes through output window 108 and enters input port 141 of optical element 140.

Optical element 140 includes an input port 141, shaped sidewall 142, and output port 143. A perimeter of optical element 140 may be measured at any particular cross-section of optical element 140 with a plane parallel to output window 108. By way of example, plane C is parallel to output window 108 and intersects optical element 140 at the output port 143. The perimeter of optical element 140 at the output port 143 is the perimeter of the intersection of plane C with optical element 140 at the output port 143. Similarly, plane B intersects optical element 140 at the input port 141 and the perimeter of optical element 140 at the input port 141 is the perimeter of the intersection of plane B with optical element 140 at the input port 141. Plane A intersects optical element 140 where the perimeter of the intersection of optical element 140 with any plane parallel to output window 108 is at a maximum value.

In one aspect, shaped sidewall 142 is shaped such that the perimeter of optical element 140 increases from the perimeter at the input port to a maximum perimeter and then decreases from the maximum perimeter to the perimeter at the output port 143.

As depicted, shaped sidewall 142 is semi-transparent and a portion of light emitted from LED based illumination module 100 exits luminaire 150 through shaped sidewall 142. In addition, a portion of light emitted from LED based illumination module 100 exits optical element 140 through output port 143. In some embodiments, output port 143 includes a lens 144. By way of example, lens 144 may be a Fresnel lens, a spherical lens, an aspherical lens, etc. In some embodiments lens 144 may have a focal length that is the same as the distance between lens 144 and output window 108. In this manner, an image of output window 108 may be projected into the far field. In some other embodiments, the focal length and location of lens 144 may be selected such that an image of output window 108 may be projected at a particular distance in the far field. In some other embodiments, the focal length and location of lens 144 may be selected to defocus the image of output window 108 at a particular distance to achieve a desired illumination effect.

In some embodiments, any of lens 144 and shaped sidewall 142 may include a color converting material (e.g., phosphor material) or a color filtering material (e.g., dichroic material). For example, a color filtering material may be included in portions of optical element 140 to achieve a desired illumination effect.

As discussed, a portion of light emitted from LED based illumination module 100 is directed through output port 143 and another portion is directed through semi-transparent sidewall 142. The proportion of emitted light directed to the output port 143 and sidewall 142 may be altered based on any of the shape of optical element 140, coatings applied to surfaces of optical element 140, and particles embedded in optical element 140. Similarly, the angular distribution of light emitted from sidewall 142 may be altered based on any of the shape of optical element 140, coatings applied to surfaces of optical element 140, and particles embedded in optical element 140.

Figure 7:
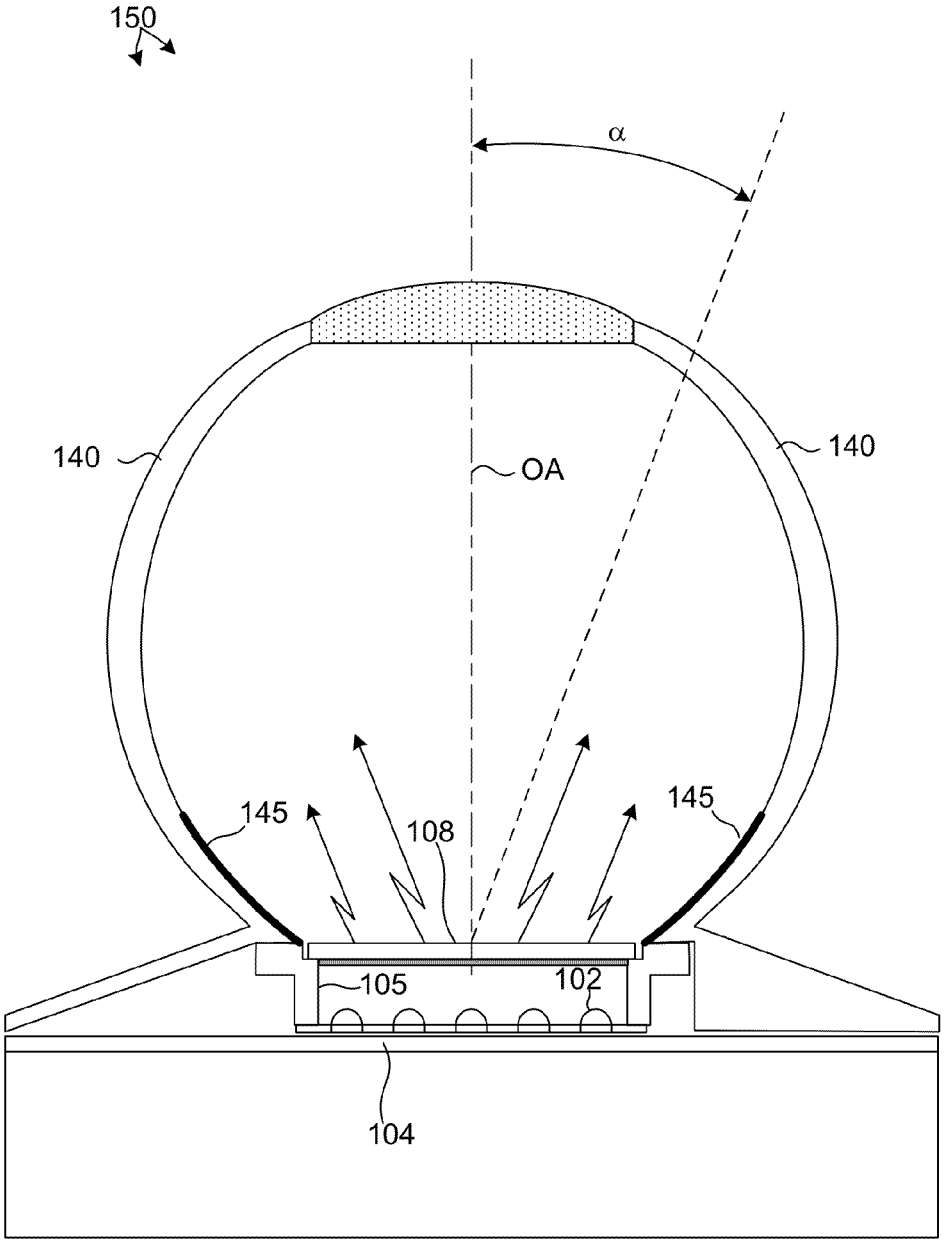
FIG. 7 is illustrative of a cross-sectional, side view of another luminaire with an optical element similar to that shown in FIG. 6, but configured to promote light transmission through sidewall at smaller angles with respect to the optical axis than that shown in FIG. 6.

In the embodiment depicted in FIG. 6, shaped sidewall 142 may include a reflective element 145. Reflective element 145 may exhibit either a specular or diffuse property. In some examples, reflector 145 may be a coating applied to optical element 140, (e.g., a metallic coating, a coating of reflective particles, etc.). In another example, reflector 145 may be an additional mechanical element coupled to optical element 140. In another example, a portion of sidewall 145 may be selectively constructed with a different surface treatment (e.g., surface roughening) to promote light scattering in the selected portion. Depending on its location relative to optical element 140, reflective element 145 can direct light transmission through sidewall 142 in particular directions. In the depicted embodiment, reflector 145 promotes light transmission through sidewall 142 at larger angles, $\alpha$, with respect to the optical axis, OA, at the expense of light transmission through sidewall 142 at smaller angles. FIG. 7 depicts the opposite scenario. In FIG. 7, reflector 145 is located close to LED based illumination module 100. In the depicted embodiment, reflector 145 promotes light transmission through sidewall 142 at smaller angles, $\alpha$, with respect to the optical axis, OA, at the expense of light transmission through sidewall 142 at larger angles.

Figure 8:
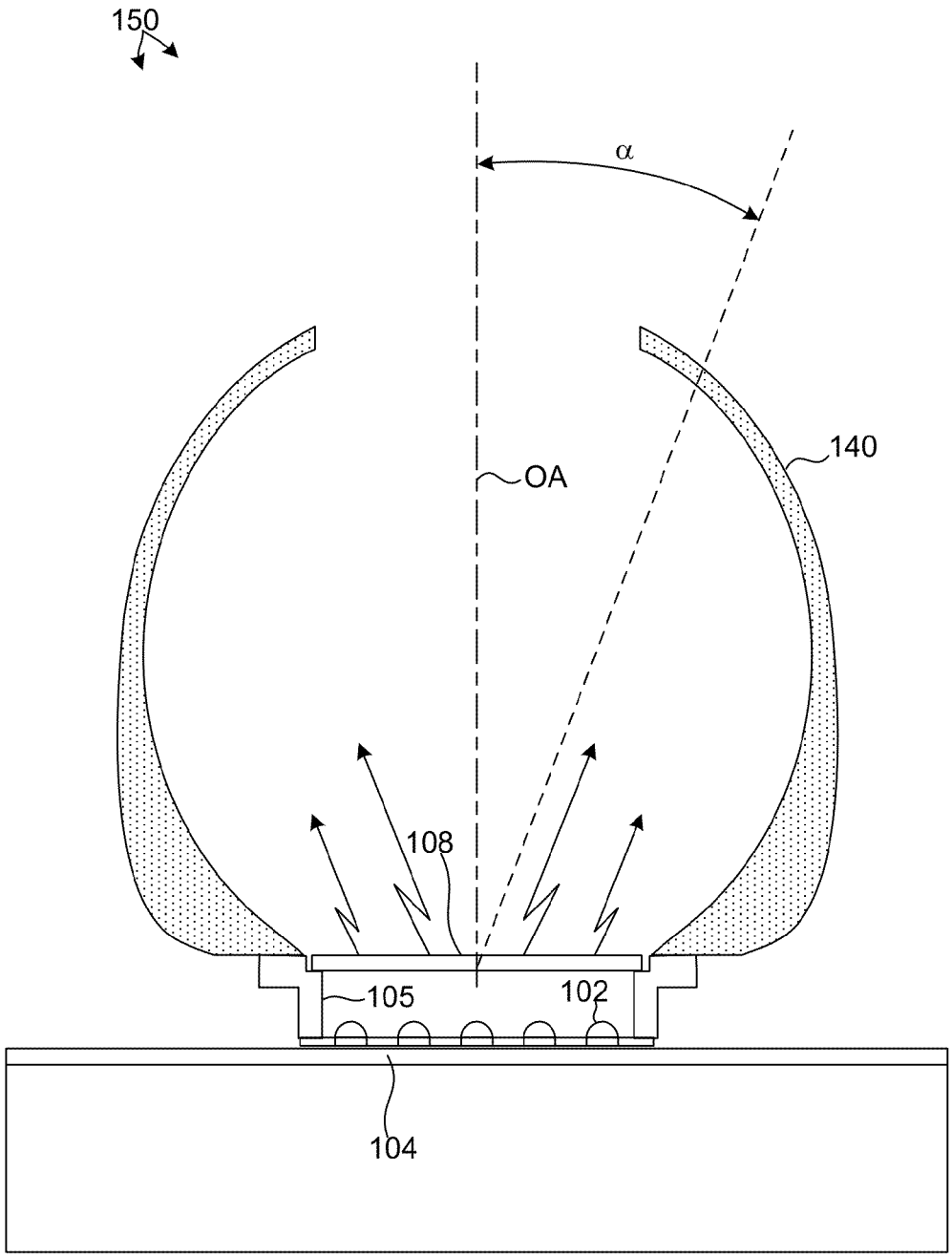
FIG. 8 is illustrative of a cross-sectional, side view of another luminaire with an optical element similar to that shown in FIG. 6, but configured sidewalls of varying thickness to alter transmission properties of the sidewalls.

In another embodiment, sidewall 142 is constructed from a mold material that includes light scattering particles (e.g., titanium dioxide particles, etc.). By varying the thickness of sidewall 142, different light transmission properties can be achieved in different areas of sidewall 142 (i.e., thicker portions of sidewall 142 reflect more light than thinner portions of sidewall 142). For example, as illustrated in FIG. 8, a portion of optical element 140 closest to LED based illumination module 100 is thicker than a portion farther away. In this manner, light transmission at smaller far field angles is promoted at the expense of light transmission at larger field angles.

In another aspect, as illustrated in FIG. 6, optical element 140 includes a reflective surface 146 to redirect light emitted from optical element 140. LED based illumination module 100 includes surfaces that absorb light (e.g., cavity body 105, mounting board retaining ring 103, and mounting base 101). Reflective surface 146 is located to reflect light emitted from optical element 140 toward the far field and avoid absorption of this light by the non-emitting surfaces of LED based illumination module 100.

Figure 9:
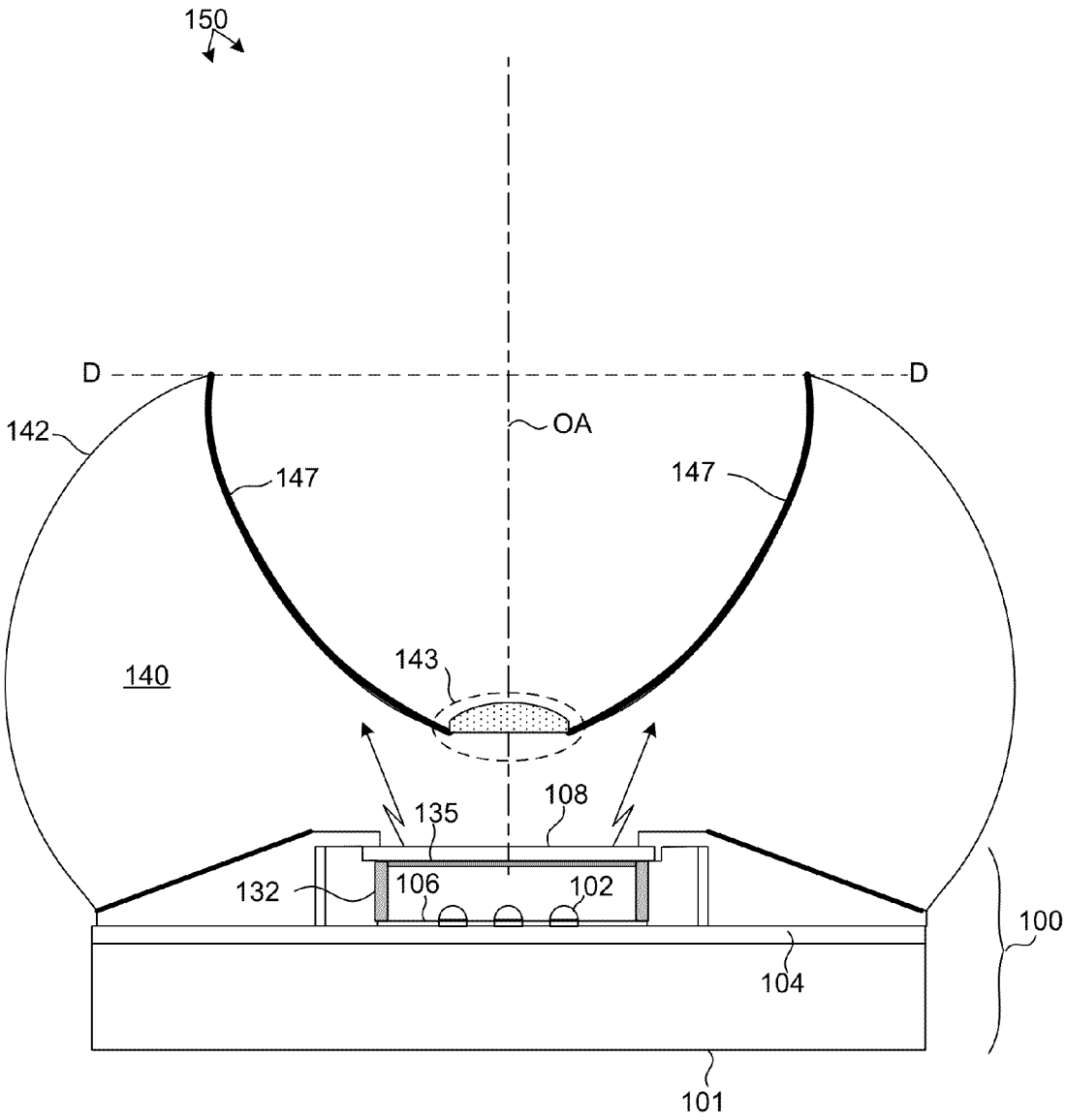
FIG. 9 is illustrative of a cross-sectional, side view of another luminaire with an optical element similar to that shown in FIG. 6, but with the output port located below the maximum height of the optical element.

FIG. 9 illustrates optical element 140 in another embodiment. As illustrated, output port 143 is located above output window 108 of LED based illumination module 100, but below the maximum height of optical element 140. As depicted, shaped sidewall 142 is semi-transparent and a portion of light emitted from LED based illumination module 100 exits luminaire 150 through shaped sidewall 142. Shaped sidewall 142 is shaped such that a perimeter of optical element 140 increases from the perimeter at the input port to a maximum perimeter and then decreases from the maximum perimeter to an inflection plane (depicted as inflection plane D in FIG. 9) where optical element 140 reaches a maximum height. At the inflection plane, the surface of optical element 140 stops increasing in height and begins to decrease in distance from the input port. From the inflection plane, the perimeter of optical element 140 continues to decrease to the perimeter at output port 143 of optical element 140.

The surface 147 of optical element 140 between inflection plane D and optical port 144 is reflective. In this manner, the portion of light emitted through output port 143 is directed from luminaire 150 without coupling back into optical element 140. In addition, the portion of light emitted toward sidewall 142 is directed toward sidewall 142 without transmission through surface 147. In this manner, light emitted through sidewall 142 contributes to general illumination while light emitted through output port 143 contributes to spot illumination.

Figure 10:
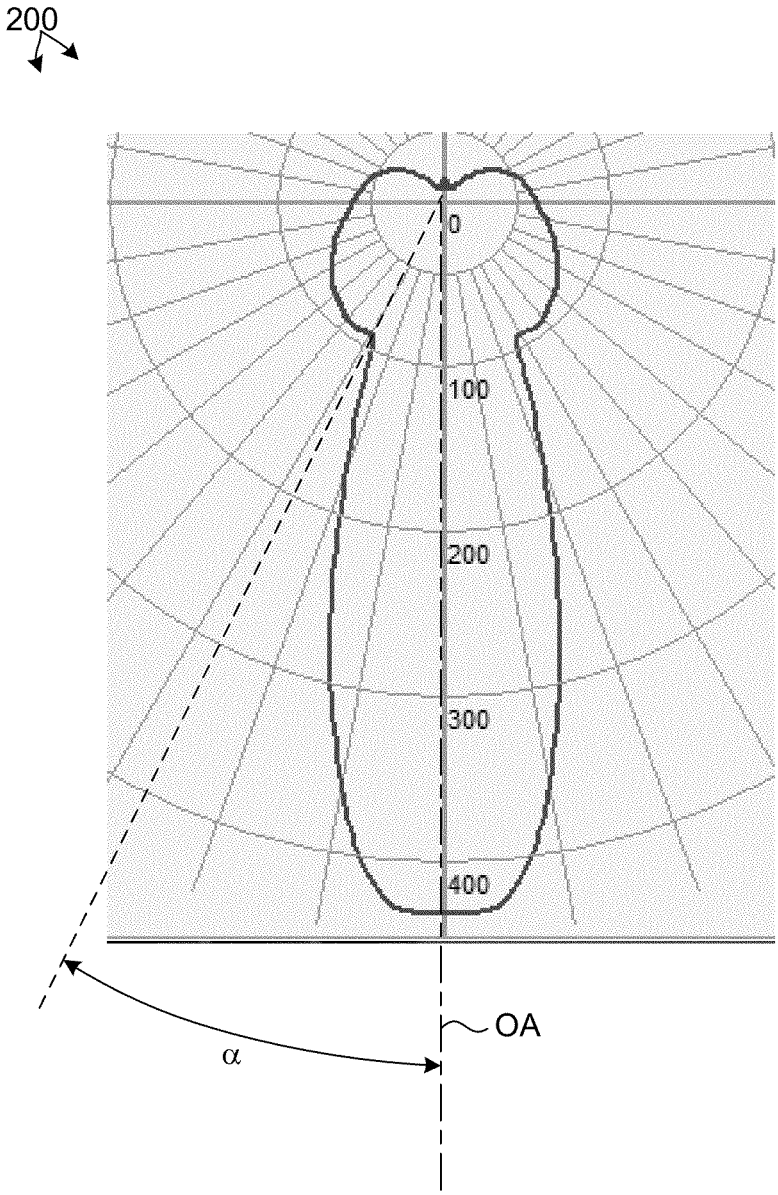
FIG. 10 is illustrative of a plot representative of an emission pattern of a luminaire with an optical element similar to that shown in FIG. 6.

FIG. 10 is illustrative of a plot 200 representative of an emission pattern of luminaire 150 with optical element 140 in combination with LED based illumination module 100. Luminaire 150 is able to generate a hybrid output beam illumination pattern as described with reference to FIG. 6. As depicted, within an illumination angle, α, or approximately twenty seven degrees, the emission pattern is a high intensity beam. Beyond an illumination angle of twenty seven degrees thirty degrees, the emission pattern resembles a general four pi illumination pattern.

Optical element 140 may be constructed from transmissive materials, such as optical grade Poly(methyl methacrylate) (PMMA), Zeonex, etc. Optical element 140 may be formed by a suitable process such as molding, extrusion, casting, machining, etc. Optical element 140 may be constructed from one piece of material or from more than one piece of material joined together by a suitable processing, such as welding, gluing, etc.

Although in the depicted embodiment, optical element 140 is spherically shaped, other shapes may be contemplated. For example, sidewall 142 may be a conical surface, a Bezier surface, an aspherical surface, a Fresnel surface, a Total Internal Reflection (TIR) surface, or a free form surface. In some examples, sidewall 142 may include diffractive optical elements or photonic crystal surfaces.

Although certain specific embodiments are described above for instructional purposes, the teachings of this patent document have general applicability and are not limited to the specific embodiments described above. For example, optical element 140 may be a replaceable component that may be removed and reattached to LED based illumination module 100. In this manner, different shaped reflectors may be interchanged with one another by a user of luminaire 150 (e.g., maintenance personnel, fixture supplier, etc.). For example, any component of color conversion cavity 160 may be patterned with phosphor. Both the pattern itself and the phosphor composition may vary. In one embodiment, the illumination device may include different types of phosphors that are located at different areas of a color conversion cavity 160. For example, a red phosphor may be located on either or both of the insert 107 and the bottom reflector insert 106 and yellow and green phosphors may be located on the top or bottom surfaces of the window 108 or embedded within the window 108. In one embodiment, different types of phosphors, e.g., red and green, may be located on different areas on the sidewalls 107. For example, one type of phosphor may be patterned on the sidewall insert 107 at a first area, e.g., in stripes, spots, or other patterns, while another type of phosphor is located on a different second area of the insert 107. If desired, additional phosphors may be used and located in different areas in the cavity 160. Additionally, if desired, only a single type of wavelength converting material may be used and patterned in the cavity 160, e.g., on the sidewalls. In another example, cavity body 105 is used to clamp mounting board 104 directly to mounting base 101 without the use of mounting board retaining ring 103. In other examples mounting base 101 and heat sink 130 may be a single component. In another example, LED based illumination module 100 is depicted in FIGS. 1-3 as a part of a luminaire 150. As illustrated in FIG. 3, LED based illumination module 100 may be a part of a replacement lamp or retrofit lamp. But, in another embodiment, LED based illumination module 100 may be shaped as a replacement lamp or retrofit lamp and be considered as such. Accordingly, various modifications, adaptations, and combinations of various features of the described embodiments can be practiced without departing from the scope of the invention as set forth in the claims.

What is claimed is:

1. An apparatus comprising:

an LED based illumination device having at least one LED operable to emit an amount of light of a first color into a color conversion cavity, the LED based illumination device having at least one color converting element disposed in the color conversion cavity, wherein a portion of the amount of light emitted from the at least one LED is color converted to a second color and emitted through an output port of the LED based illumination device; and an optical element coupled to the LED based illumination device, the optical element having an input port and an output port, and at least one curved sidewall between the input port and output port, wherein the output port of the optical element includes a lens, wherein a first portion of the amount of light emitted from the LED based illumination device is transmitted through the at least one curved sidewall and a second portion of the amount of light emitted from the LED based illumination device is transmitted through the output port of the optical element, wherein a perimeter of the optical element increases in size from a perimeter at the input port to a maximum perimeter and decreases from the maximum perimeter to a perimeter at the output port.

2. The apparatus of claim 1, wherein the amount of light emitted from the LED based illumination device passes through the input port of the optical element, wherein the input port is sized to match the output port of the LED based illumination device.

3. The apparatus of claim 1, wherein the lens is any of a Fresnel lens, a convex lens, a spherical lens, and an aspherical lens.

4. The apparatus of claim 1, wherein a distance between the lens and the output port of the LED based illumination device is approximately equal to a focal length of the lens.

5. The apparatus of claim 1, wherein the optical element comprises a lens material loaded with scattering particles.

6. The apparatus of claim 1, wherein a thickness of the optical element varies from the input port to the output port.

7. The apparatus of claim 1, wherein a portion of an interior surface of the optical element is coated with a reflective material.

8. The apparatus of claim 7, wherein the portion of the interior surface of the optical element is located between the maximum perimeter and the output port of the optical element.

9. The apparatus of claim 7, wherein the portion of the interior surface of the optical element is located between the maximum perimeter and the input port.

10. The apparatus of claim 1, wherein the optical element includes a reflector at the input port of the optical element that extends outward from the optical element.

11. An apparatus comprising:

an optical element coupleable to an LED based illumination device with a planar light emitting area, the optical element comprising, an input port operable to receive an amount of light emitted from the LED based illumination device, at least one curved, semitransparent sidewall operable to transmit a first portion of the amount of light, and an output port operable to transmit a second portion of the amount of light, wherein an emission area of the output port is less than a maximum perimeter of the optical element, wherein the output port of the optical element includes a lens.

12. The apparatus of claim 11, wherein a distance between the lens and the output port of the LED based illumination device is approximately equal to a focal length of the lens.

13. The apparatus of claim 11, wherein the optical element comprises a lens material loaded with scattering particles.

14. The apparatus of claim 11, wherein a thickness of the optical element varies from the input port to the output port.

15. The apparatus of claim 11, wherein a portion of an interior surface of the optical element is coated with a reflective material.

16. The apparatus of claim 15, wherein the portion of the interior surface of the optical element is located between the maximum perimeter and the output port.

17. The apparatus of claim 15, wherein the portion of the interior surface of the optical element is located between the maximum perimeter and the input port.

18. An apparatus comprising:

an LED based illumination device having at least one LED operable to emit an amount of light of a first color into a color conversion cavity, the LED based illumination device having at least one color converting element disposed in the color conversion cavity, wherein a portion of the amount of light emitted from the at least one LED is color converted to a second color and emitted through an output port of the LED based illumination device; and an optical element coupled to the LED based illumination device, the optical element having an input port and an output port, wherein a perimeter of the optical element increases in size from a perimeter at the input port to a maximum perimeter, decreases from the maximum perimeter to a perimeter at an inflection plane where the optical element reaches a maximum height, and further decreases from the inflection plane to a perimeter at the output port.

* * * * *